US010807389B2

(12) United States Patent
Ito

(10) Patent No.: US 10,807,389 B2
(45) Date of Patent: Oct. 20, 2020

(54) RECORDING DEVICE

(71) Applicant: SEIKO EPSON CORPORATION, Tokyo (JP)

(72) Inventor: Shun Ito, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/361,893

(22) Filed: Mar. 22, 2019

(65) Prior Publication Data

US 2019/0291476 A1 Sep. 26, 2019

(30) Foreign Application Priority Data

Mar. 26, 2018 (JP) ..... 2018-058170

(51) Int. Cl.
*B41J 11/14* (2006.01)

(52) U.S. Cl.
CPC ..... *B41J 11/14* (2013.01)

(58) Field of Classification Search
CPC ..... B41J 11/04; B41J 11/14
USPC ..... 347/101, 104, 108
See application file for complete search history.

(56) References Cited

U.S. PATENT DOCUMENTS 9,180,665 B2 * 11/2015 Nakata ..... B41J 2/14
9,409,428 B2 * 8/2016 Shuto ..... B41J 25/304
9,573,394 B2 * 2/2017 Campanini ..... B41J 11/04
10,427,428 B2 * 10/2019 Kawamata ..... B41J 2/01

FOREIGN PATENT DOCUMENTS

JP 11-207944 8/1999

* cited by examiner

*Primary Examiner* — An H Do
(74) *Attorney, Agent, or Firm* — Workman Nydegger

(57) ABSTRACT

A recording device comprising a driving roller configured to be driven by receiving a drive force from a drive source and transport a medium in a transport direction, a frame located below the driving roller and including an attachment surface extending in a device height direction intersecting the transport direction, and a driving roller support member configured to support the driving roller. The driving roller support member is removably attached to the attachment surface.

7 Claims, 16 Drawing Sheets

RECORDING DEVICE

BACKGROUND

1. Technical Field

The invention relates to a recording device that performs recording on a medium.

2. Related Art

A known recording device transports a medium to a region facing a recording head by a roller, and performs recording on the medium by using the recording head. This roller is configured as a roller body formed of, for example, a metal shaft and a ceramic adhering concentrically to an outer peripheral surface of the shaft. The recording device including the roller body rotatably supports both end portions in an axial direction of the roller body.

For example, a large recording device corresponding to a medium having a large size in a medium width direction (axial direction of a roller body) has a great length in the axial direction of the roller body. As a result, a bend occurs downward in a device height direction due to dead weight and the like of the roller body between both end portions in the axial direction of the roller body. A centrifugal whirling occurs when the roller body with the bend is rotated, which causes a decrease in transport performance of a medium in the roller body. To solve this trouble, a recording device (JP-A-11-207944) is provided that includes a bearing supporting the roller body at appropriate intervals in the axial direction of the roller body.

In the recording device described in JP-A-11-207944, a shaft of the long roller body is rotatably supported by the bearing provided at the appropriate intervals in the axial direction. This bearing is provided to be fixed to a substrate.

In an environment in which a recording device is used, dust, sand, and the like may enter the recording device. The dust and sand entering the device also enters between the shaft of the roller body and the bearing. As a result, the shaft and the bearing may be damaged, and rotation accuracy of the roller body may not be maintained. In this case, the maintenance operation of, for example, replacing parts of the bearing is needed. However, since the bearing is provided to be fixed to the substrate, the operation of replacing parts is not easy, which results in poor maintainability.

SUMMARY

Thus, the invention is to provide a recording device including a bearing having excellent maintainability.

To solve the above-described problem, the recording device according to a first aspect of the invention includes a driving roller configured to be driven by receiving a drive force from a drive source and transport a medium in a transport direction, a frame located below the driving roller and including an attachment surface extending in a device height direction intersecting the transport direction, and a driving roller support member configured to support the driving roller. The driving roller support member is removably attached to the attachment surface.

According to the aspect, the driving roller support member is removably attached to the attachment surface. Thus, the driving roller support member can be attached to and removed from the attachment surface by accessing the attachment surface. As a result, replacement of the driving roller support member can be facilitated, and the maintainability of the driving roller support member in the recording device can be improved.

The recording device according to a second aspect of the invention in the first aspect includes a base member fixable to the attachment surface. The driving roller support member is removably attached to the attachment surface through the base member. The base member is configured to be positioned with respect to the driving roller, with the driving roller support member being attached to the attachment surface through the base member.

According to the aspect, the driving roller support member is removably attached to the attachment surface through the base member, and the base member is configured to be positioned with respect to the driving roller, with the driving roller support member being attached to the attachment surface through the base member. For example, when the base member is fixed to the attachment surface by a fastening member and the like such as a screw and a bolt, a position of the base member with respect to the attachment surface is temporarily determined by temporarily fastening the fastening member and the like. Subsequently, the driving roller support member attached to the base member is positioned with respect to the driving roller, and the base member is fixed to the attachment surface by finally fastening the fastening member and the like. In this way, positioning of the attachment surface and the base member is performed. Thus, even when replacement of the driving roller support member is performed on the base member, accuracy of the position of the driving roller support member with respect to the driving roller is secured by the attachment surface and the base member. As a result, the maintainability of the driving roller support member in the recording device can be further improved.

In the recording device according to a third aspect of the invention in the second aspect, the base member includes a first protruding portion protruding in the transport direction. The driving roller support member includes a second protruding portion protruding in an axial direction of the driving roller intersecting the transport direction and the device height direction. The second protruding portion comes into contact with the first protruding portion from the device height direction. The driving roller support member is configured to be switchable between a restriction state and an allowable state, the driving roller support member in the restriction state being restricted from changing a position thereof downward in the device height direction when the first protruding portion and the second protruding portion are in contact with each other, and the driving roller support member in the allowable state being allowed to change a position thereof downward in the device height direction when a contact state between the first protruding portion and the second protruding portion is released.

According to the aspect, the driving roller support member is configured to be switchable between the restriction state and the allowable state, the driving roller support member in the restriction state being restricted from changing the position thereof downward in the device height direction when the first protruding portion and the second protruding portion are in contact with each other, and the driving roller support member in the allowable state is allowed to change the position thereof downward in the device height direction when the contact state between the first protruding portion and the second protruding portion is released. Thus, the driving roller support member positioned with respect to the driving roller can be moved downward in the device height direction by switching the driving roller support member from the restricted state to the allowable state. As a result, the positioned state can be released in the driving roller support member, and the driving roller support member moves in a direction away from the driving roller. This can facilitate removing and replacing the driving roller support member. As a result, the maintainability of the driving roller support member can be improved.

Note that, "contact" also includes a state where, for example, the first protruding portion and the second protruding portion are provided with engagement portions, and the first protruding portion and the second protruding portion engage with each other. Further, "contact" also includes a contact by a surface contact and a contact by a point contact and a line contact.

In the recording device according to a fourth aspect of the invention in the first aspect, a first protruding portion protruding in the transport direction is formed on the attachment surface of the frame. The driving roller support member includes a second protruding portion protruding in an axial direction of the driving roller intersecting the transport direction and the device height direction. The second protruding portion comes into contact with the first protruding portion from the device height direction. The driving roller support member is configured to be switchable between a restriction state and an allowable state, the driving roller support member in the restriction state being restricted from changing a position thereof downward in the device height direction when the first protruding portion and the second protruding portion are in contact with each other, and the driving roller support member in the allowable state being allowed to change a position thereof downward in the device height direction when a contact state between the first protruding portion and the second protruding portion is released.

According to the aspect, an action effect similar to that in the above-mentioned third aspect can be obtained.

In the recording device according to a fifth aspect of the invention in the third or fourth aspect, the driving roller support member includes a first support member configured to rotatably support the driving roller, and a second support member configured to support the first support member. The second support member includes a first inclined portion including a first inclined surface inclined with respect to the device height direction, and a second inclined portion allowed to change a position thereof along the first inclined surface and configured to support the first support member. The second inclined portion is configured to perform positioning of the first support member with respect to the driving roller in the transport direction and the device height direction by changing a position of the second inclined portion along the first inclined surface, and be fixable to the first inclined portion.

According to the aspect, the second inclined portion is configured to allow for the first support member with respect to the driving roller in the transport direction and the device height direction by changing a position of the second inclined portion along the first inclined surface. In this way, the second inclined portion can be fixed to the first inclined portion after positioning of the first support member with respect to the driving roller, and thus positioning of the driving roller support member with respect to the driving roller can be facilitated.

The recording device according to a sixth aspect of the invention in any of the first to fifth aspects includes a pair of side frames respectively attached to both end portions in the axial direction of the frame. The pair of side frames rotatably support both end portions in the axial direction of the driving roller.

According to the aspect, an action effect similar to that in any of the above-mentioned first to fifth aspects can be obtained.

The recording device according to a seventh aspect of the invention in any of the first to sixth aspects includes a path formation member provided upstream from the driving roller in the transport direction and constitutes a part of a transport path for the medium, and a position defining member configured to define a position of the path formation member in the device height direction. The position defining member is supported by the driving roller support member.

According to the aspect, the path formation member provided upstream from the driving roller in the transport direction and constitutes the part of the transport path of the medium, and the position defining member configured to define the position of the path formation member in the device height direction are provided, and the position defining member is supported by the driving roller support member. Thus, the position defining member supported by the driving roller support member can define the position of the path formation member in the device height direction. Furthermore, the driving roller support member is positioned with respect to the driving roller in the aspect. Therefore, the path formation member is positioned with respect to the driving roller in the device height direction through the position defining member and the driving roller support member. In this way, alignment of the path formation member can also be performed in the maintenance operation of the driving roller support member, and the operability can be improved.

The recording device according to an eighth aspect of the invention in any of the first to seventh aspects includes a device body including the frame, and a cover member removably attached to a rear side of the device body. The attachment surface and the driving roller support member are exposed to the outside of the device body when the cover member is removed from the device body.

According to the aspect, the attachment surface and the driving roller support member are exposed to the outside of the device body by removing the cover member, and thus access from the outside of the device body to the attachment surface and the driving roller support member can be facilitated. In this way, the recording device can have excellent maintainability.

The recording device according to a ninth aspect of the invention in any of the first to eighth aspects includes a recording head configured to discharge liquid to a medium fed by the driving roller, to perform recording.

According to the aspect, an action effect similar to that in any of the above-mentioned first to eighth aspects can be obtained.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
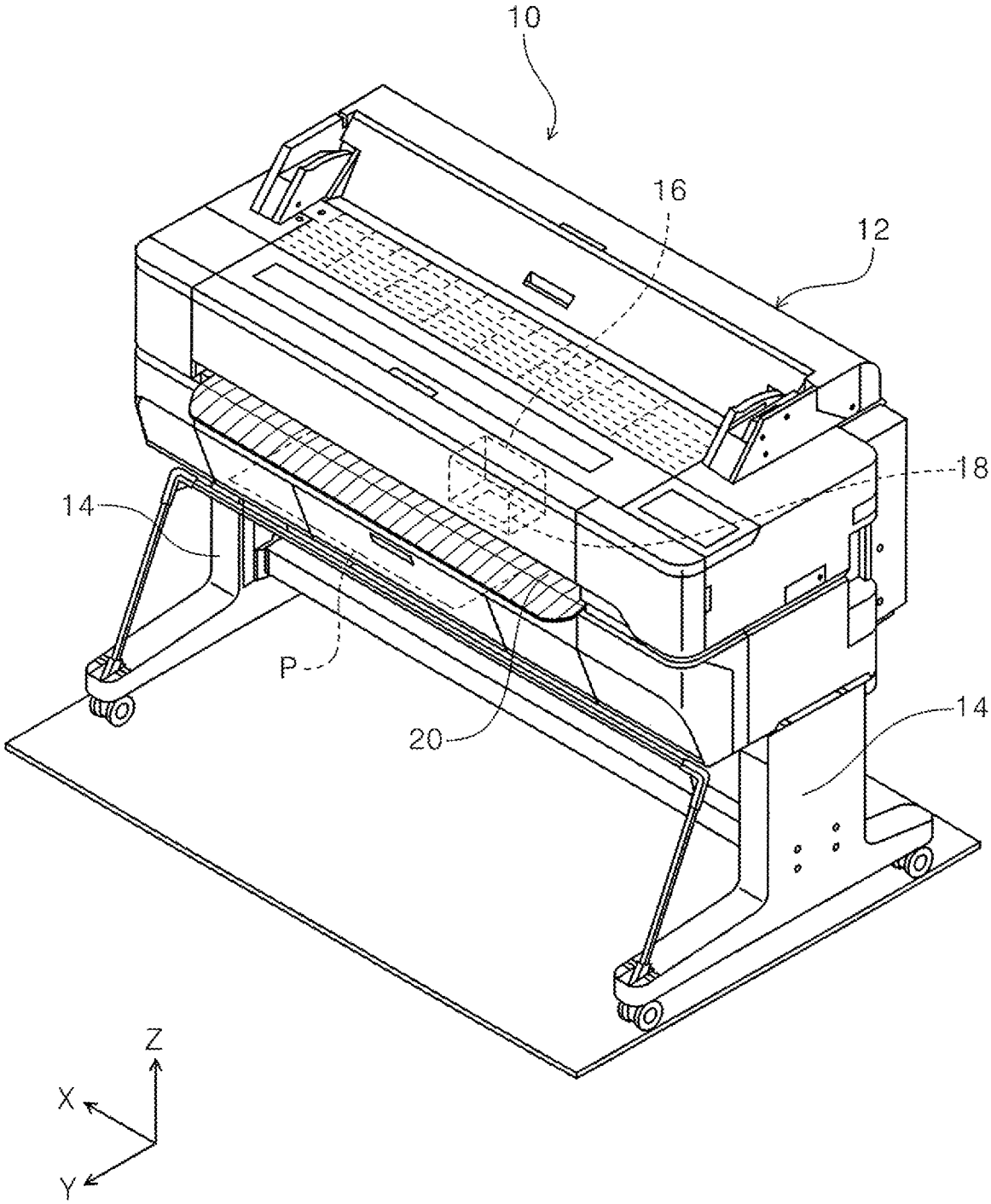
FIG. 1 is an external perspective view of a printer according to the invention.

Exemplary embodiments of the invention will be described with reference to the drawings. Note that, the same configuration in respective exemplary embodiments is provided with the same reference numeral and is described only in the first exemplary embodiment, and description of the configuration will be omitted from the subsequent exemplary embodiments.

Figure 2:
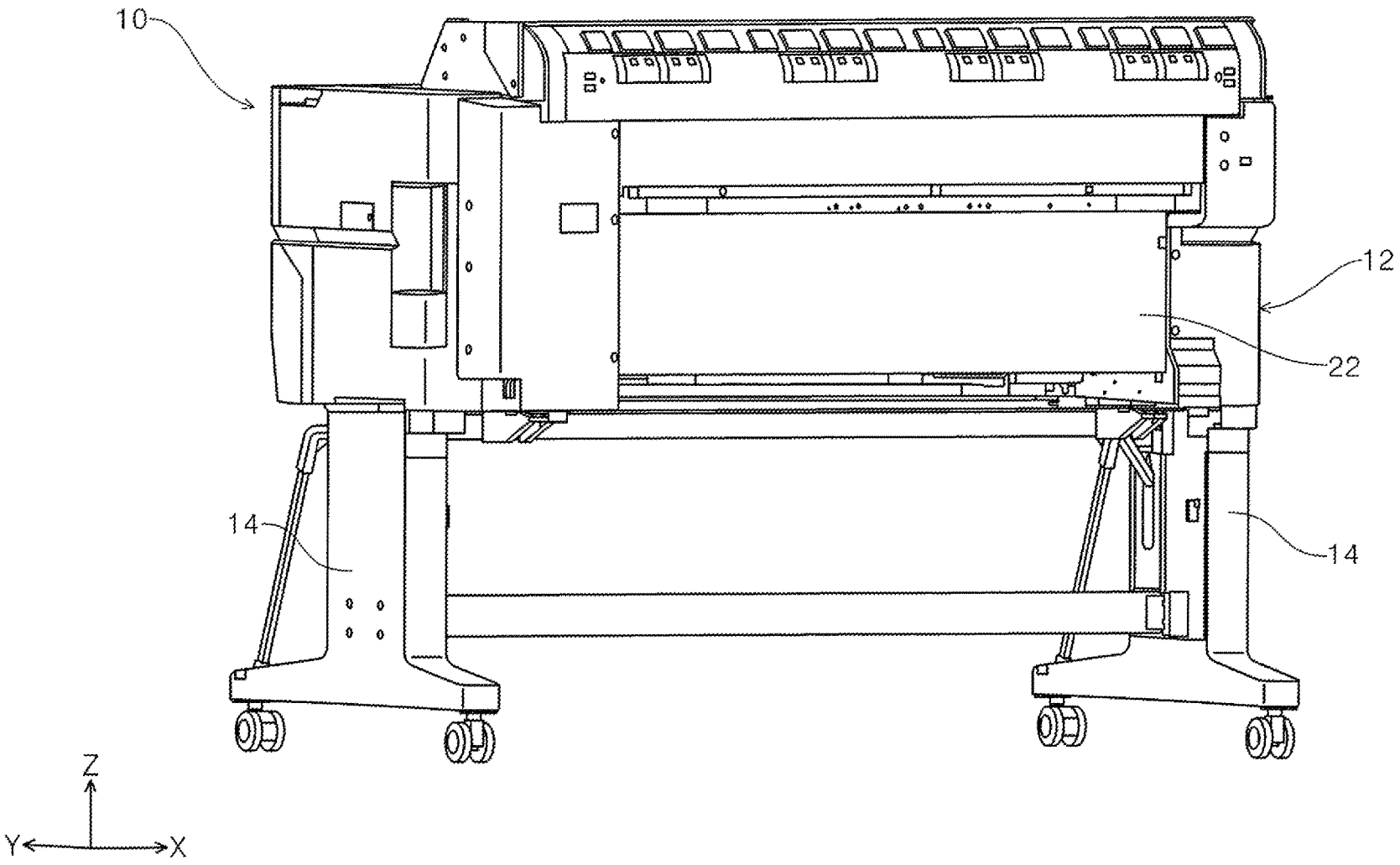
FIG. 2 is a rear-side perspective view of the printer according to the invention.
Figure 3:
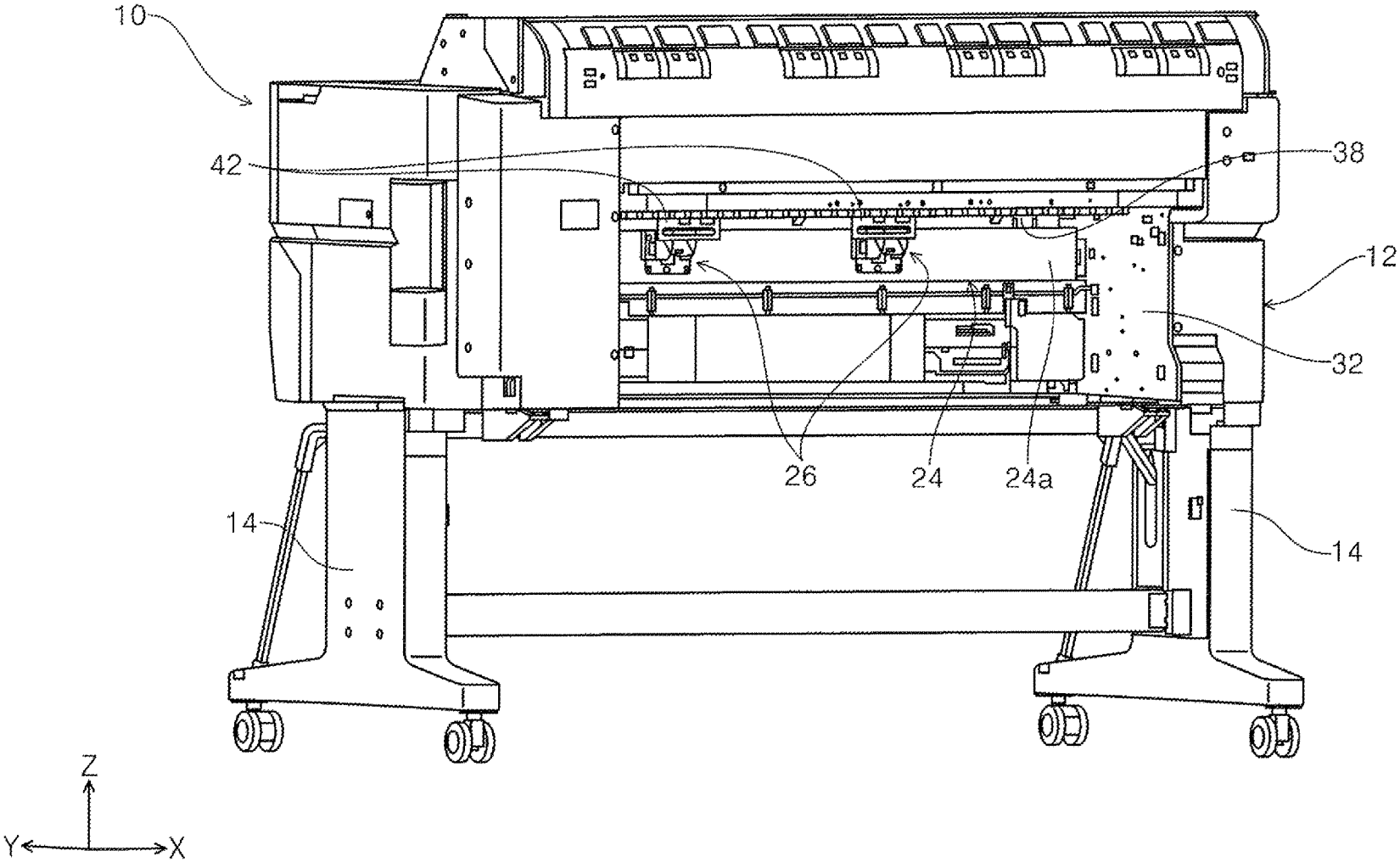
FIG. 3 is a perspective view illustrating a state where a cover member is removed to expose a driving roller support member in the printer.

FIG. 1 is an external perspective view of a printer according to the invention. FIG. 2 is a rear-side perspective view of the printer according to the invention. FIG. 3 is a perspective view illustrating a state where a cover member is removed to expose a driving roller support member in the printer.

Figure 4:
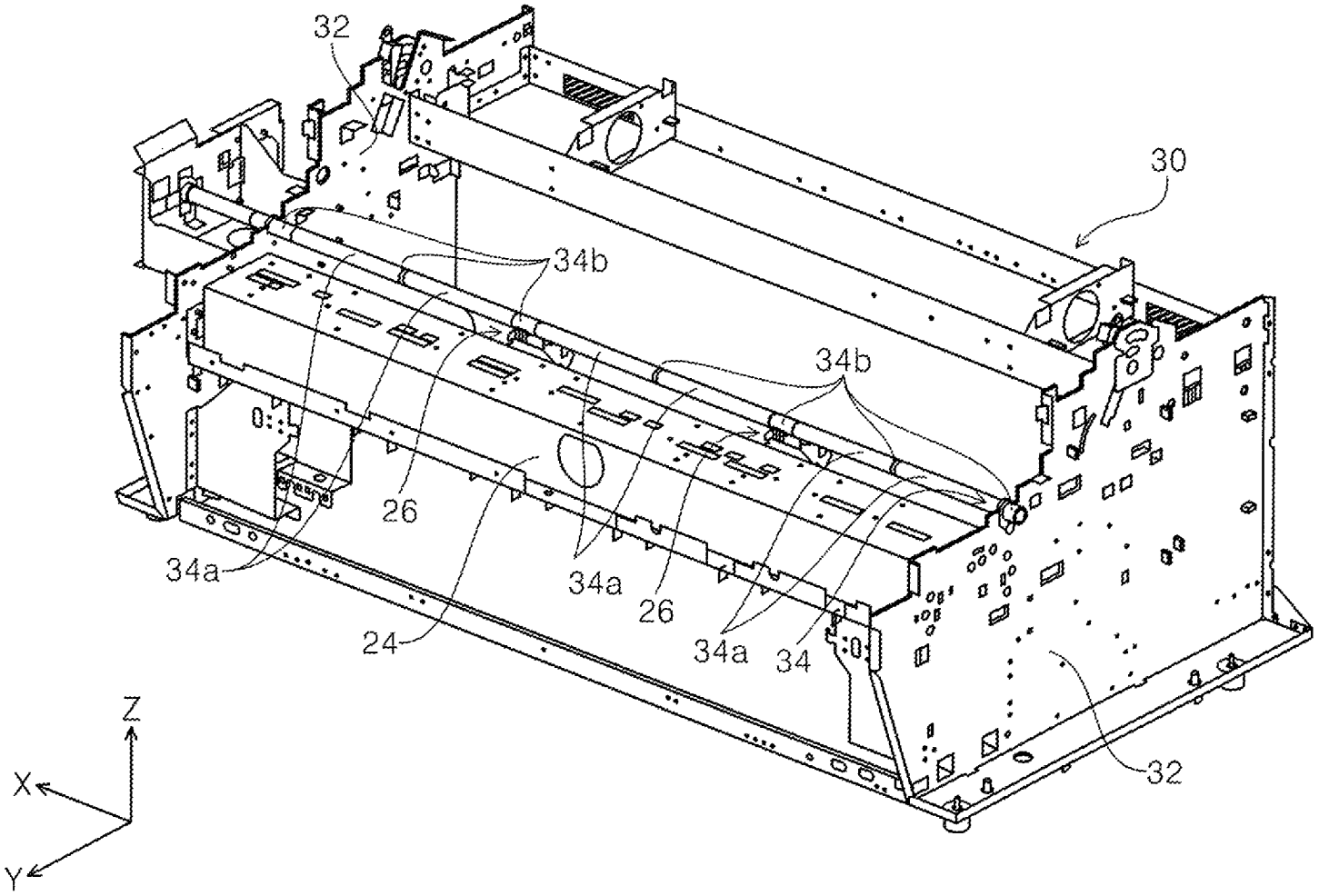
FIG. 4 is a perspective view illustrating a driving roller supported by a pair of side frames.
Figure 5:
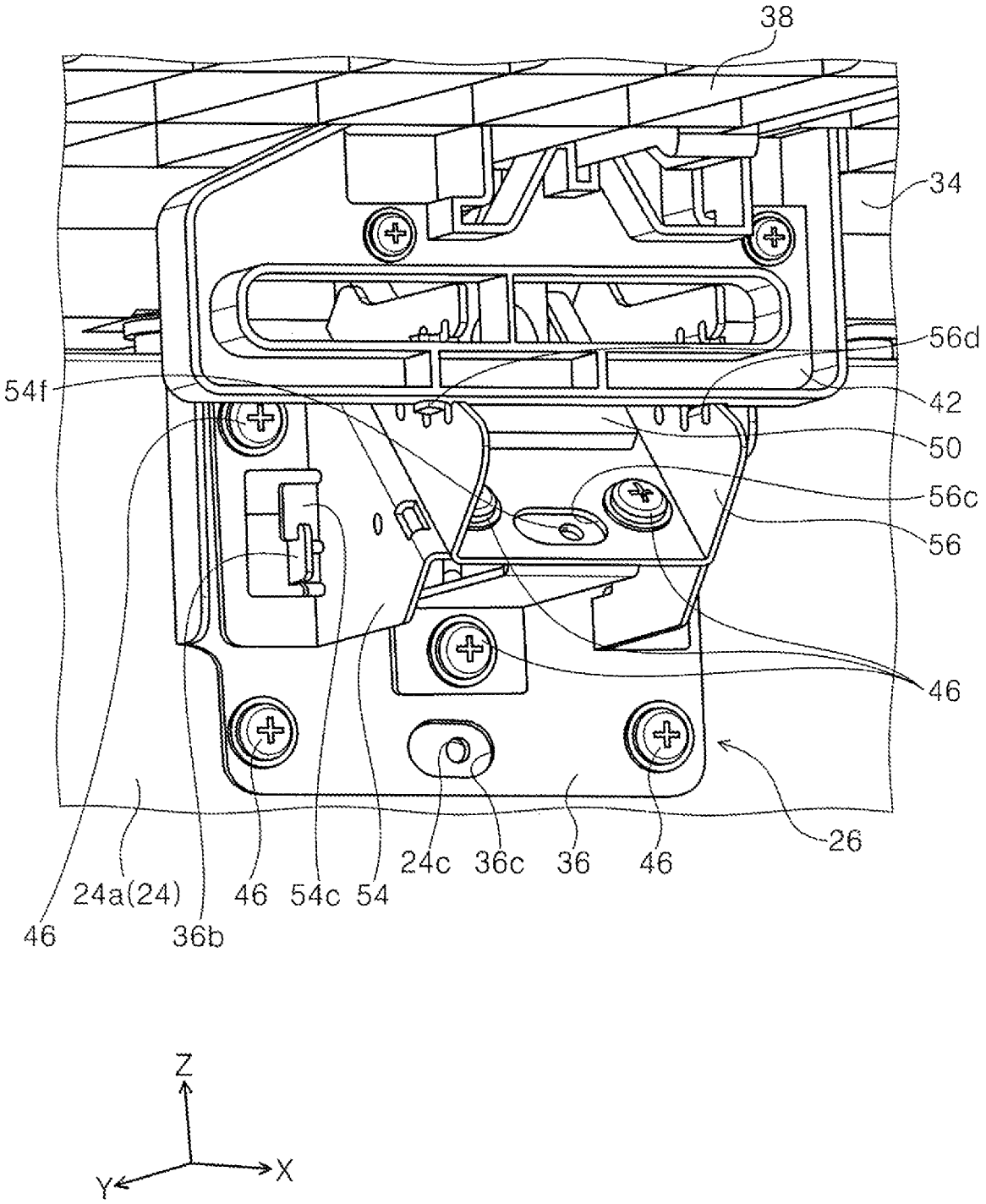
FIG. 5 is an enlarged view of the driving roller support member in FIG. 3.

FIG. 4 is a perspective view illustrating a driving roller supported by a pair of side frames. FIG. 5 is an enlarged view of the driving roller support member in FIG. 3.

Figure 6:
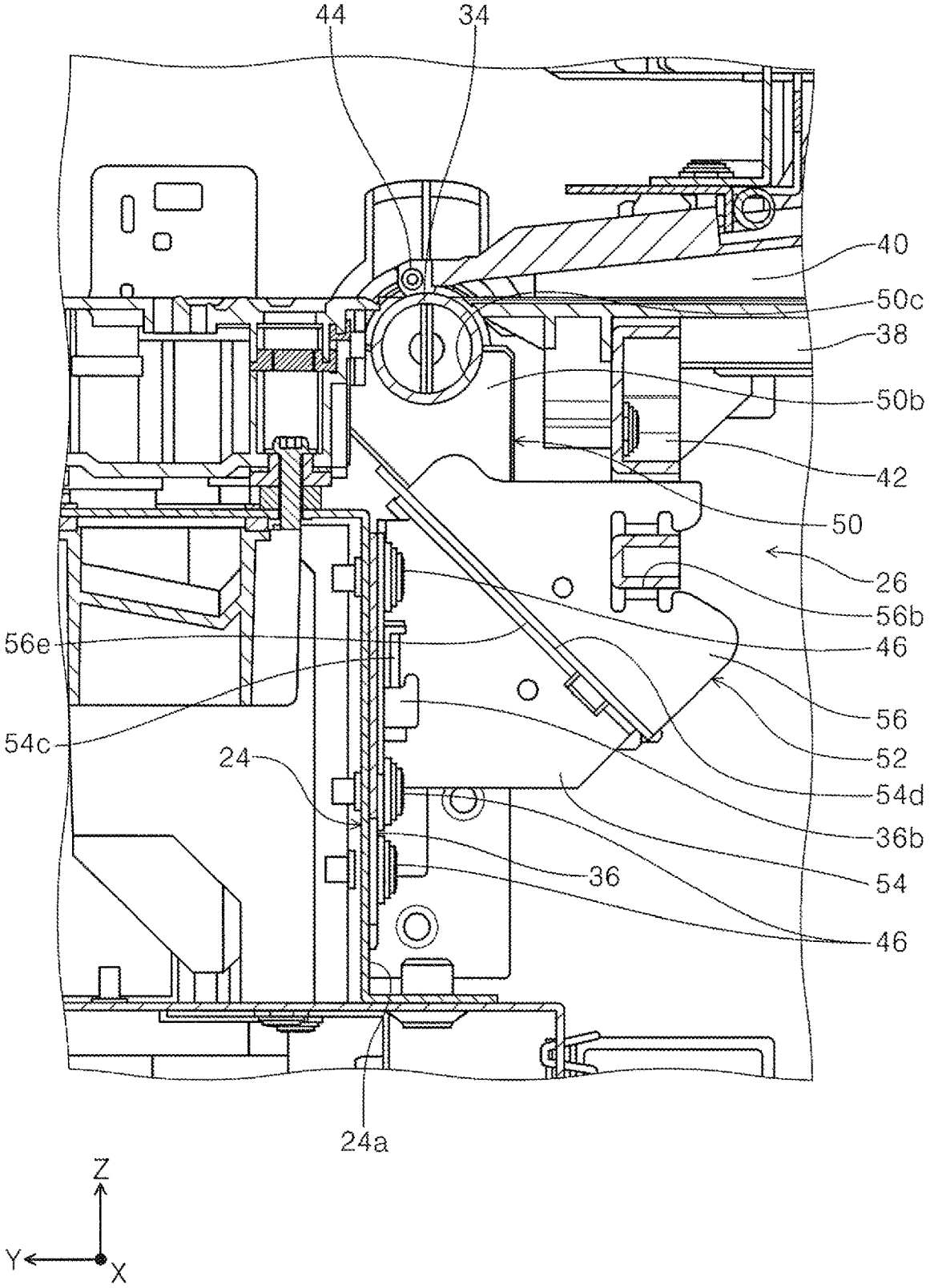
FIG. 6 is a cross-sectional side view illustrating a positional relationship among the driving roller, the driving roller support member, and a path formation member.

FIG. 6 is a cross-sectional side view illustrating a positional relationship among the driving roller, the driving roller support member, and a path formation member.

Figure 7:
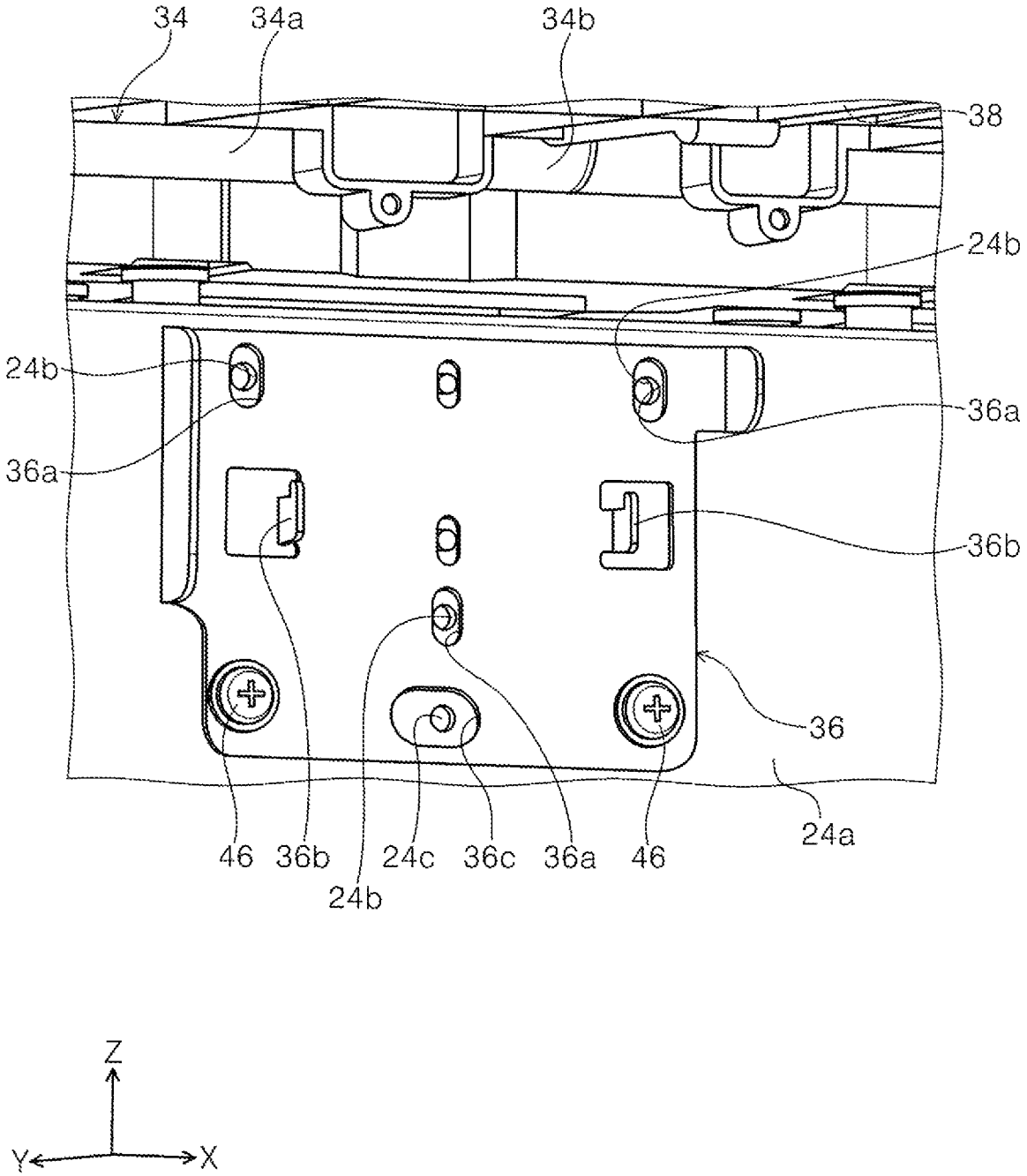
FIG. 7 is a perspective view illustrating a base member attached to an attachment surface.
Figure 8:
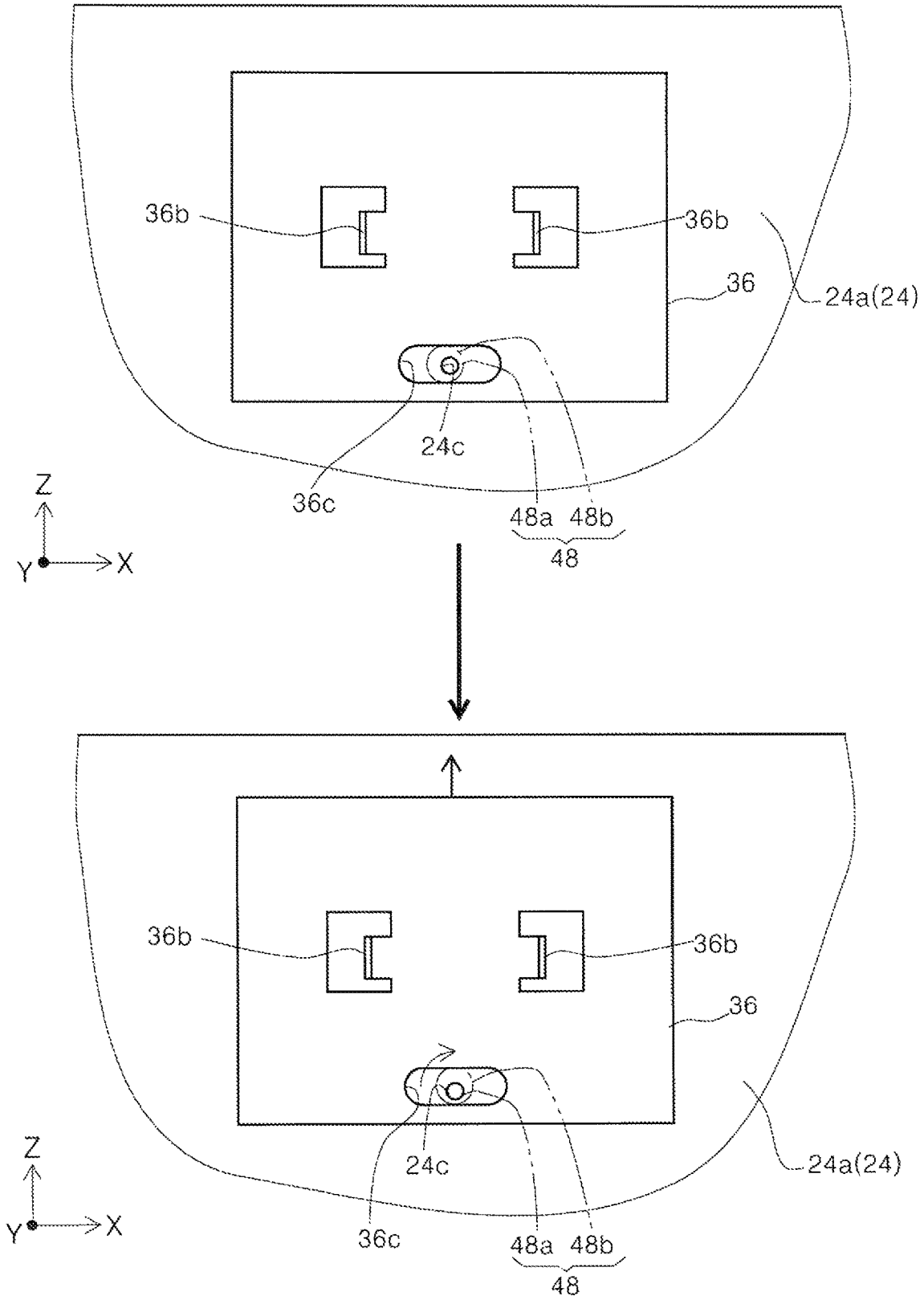
FIG. 8 is a schematic view illustrating positioning of the base member with respect to the attachment surface.
Figure 9:
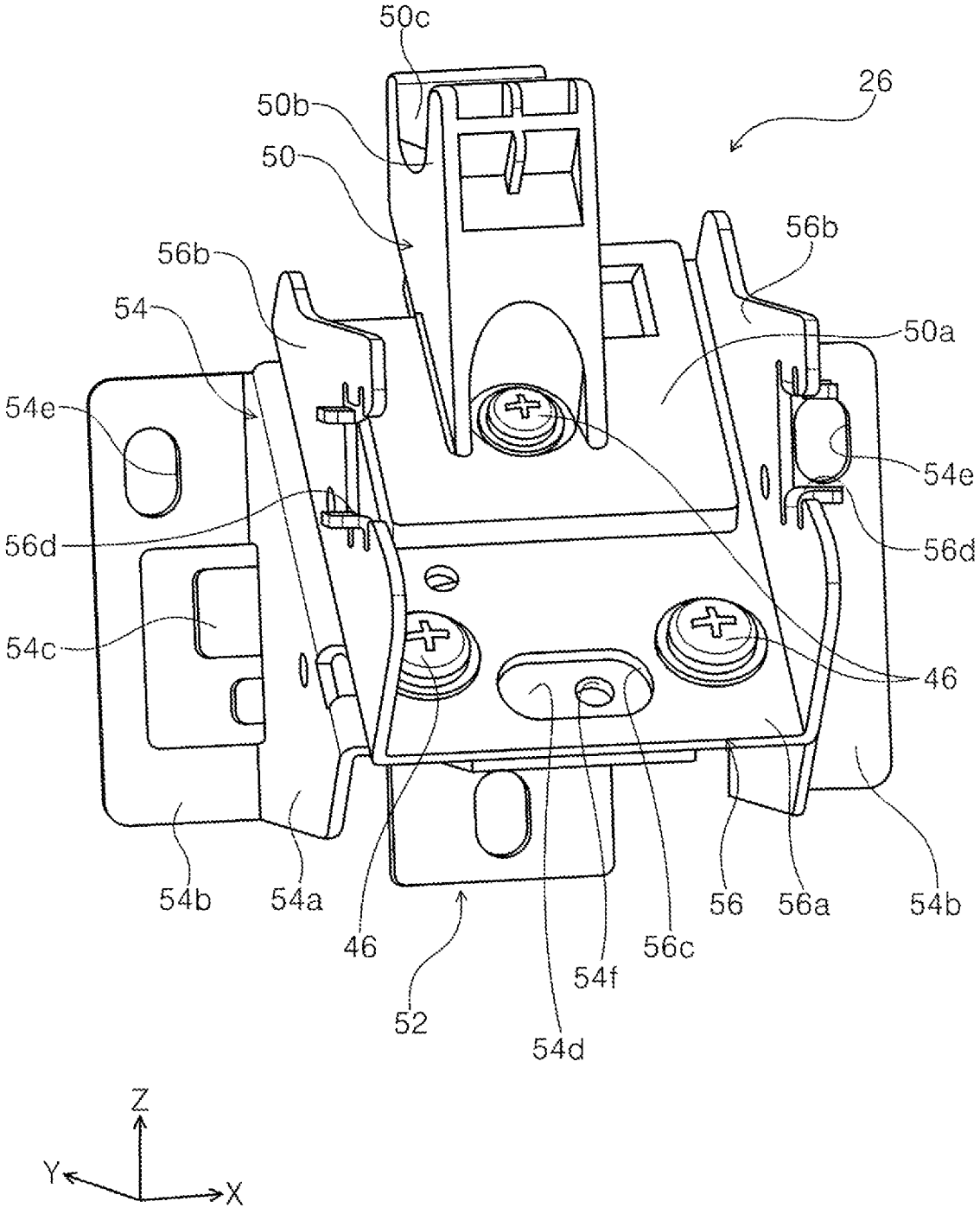
FIG. 9 is a perspective view of the driving roller support member.

FIG. 7 is a perspective view illustrating a base member attached to an attachment surface. FIG. 8 is a schematic diagram illustrating positioning of the base member with respect to the attachment surface. FIG. 9 is a perspective view of the driving roller support member.

Figure 10:
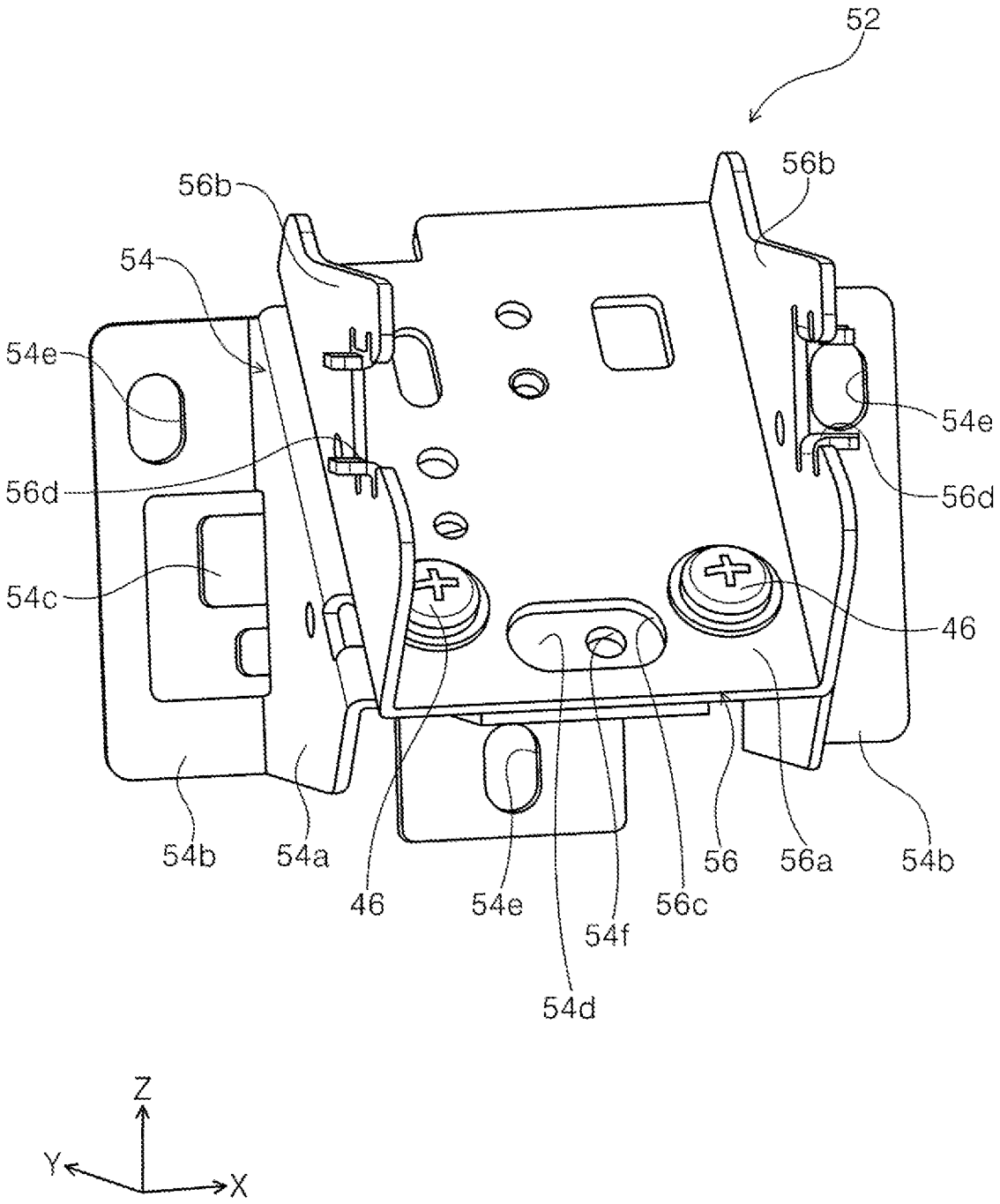
FIG. 10 is a perspective view of a second support member.
Figure 11:
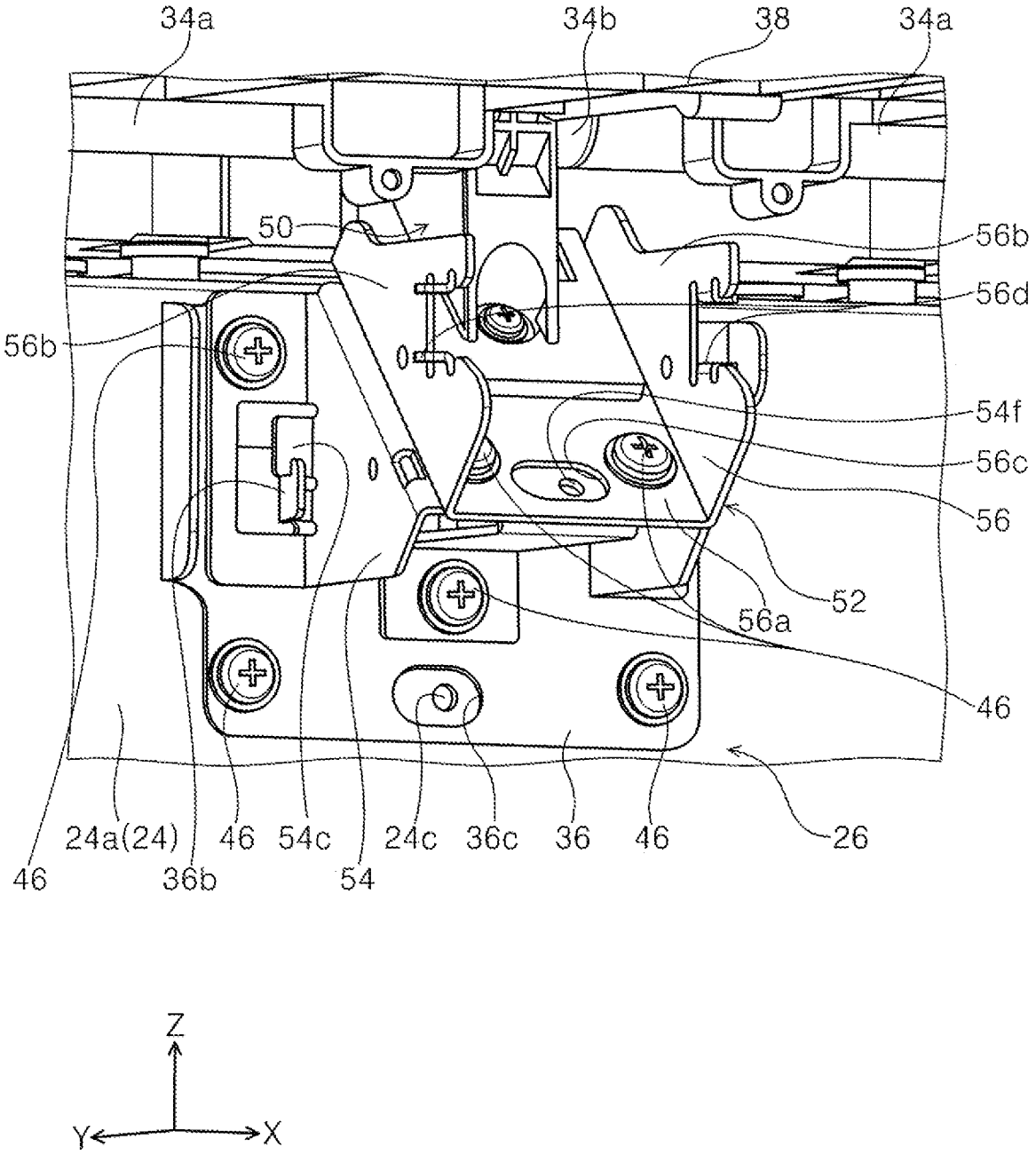
FIG. 11 is a perspective view illustrating a state where the driving roller support member is restricted with respect to the base member.
Figure 12:
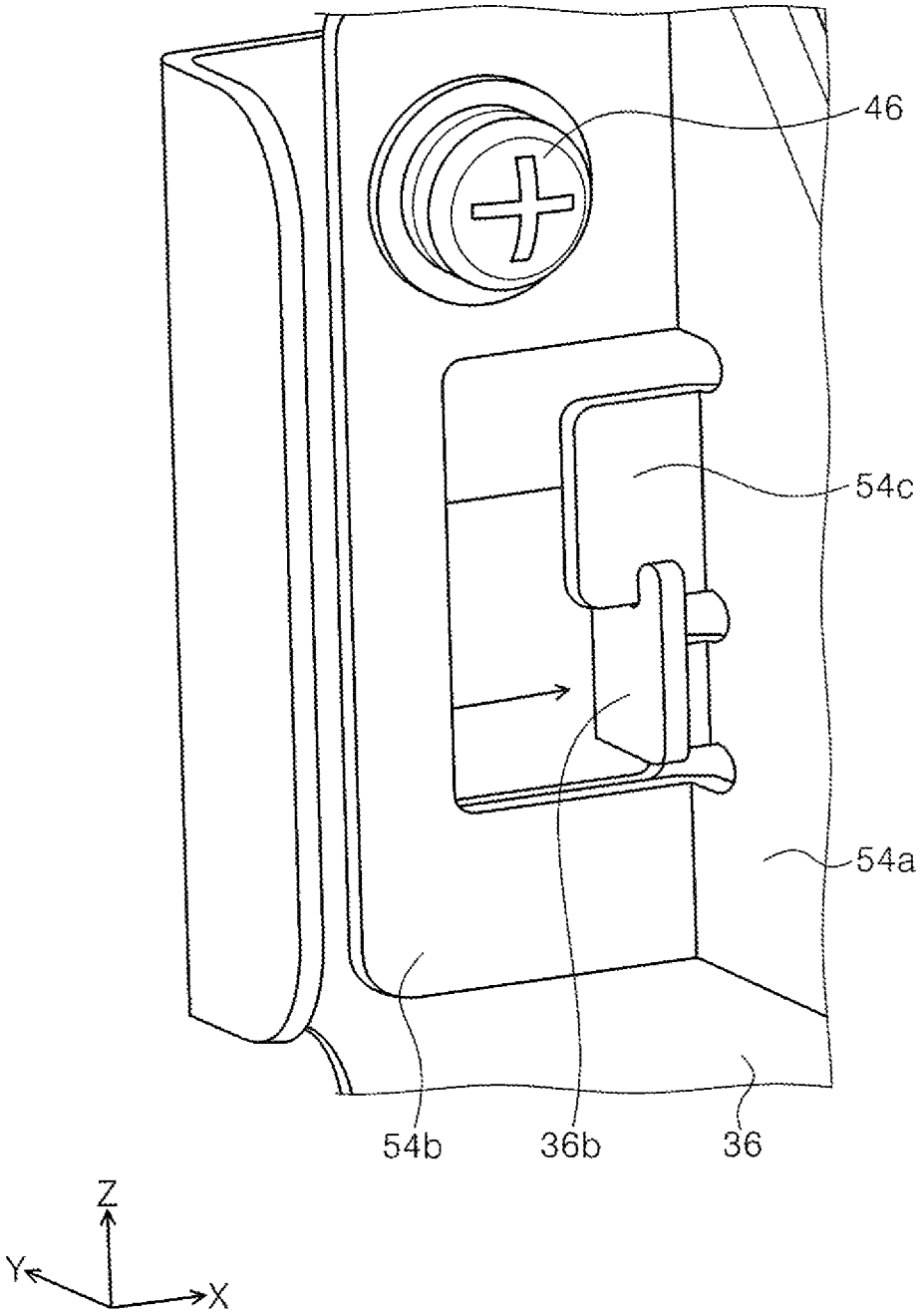
FIG. 12 is a perspective view illustrating a contact state between a first protruding portion and a second protruding portion.

FIG. 10 is a perspective view of a second support member. FIG. 11 is a perspective view illustrating a state where the driving roller support member is restricted with respect to the base member. FIG. 12 is a perspective view illustrating a contact state between a first protruding portion and a second protruding portion.

Figure 13:
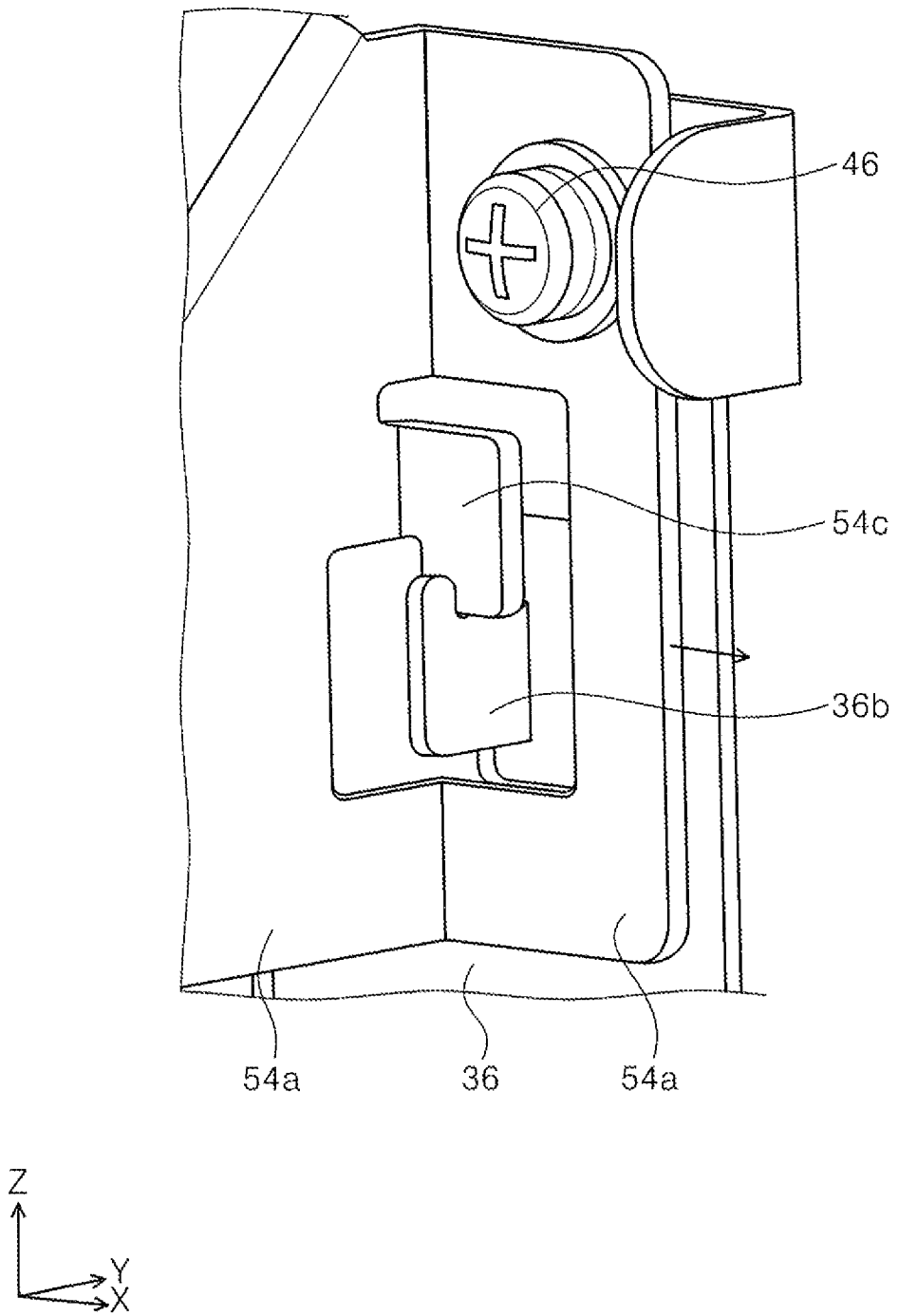
FIG. 13 is a perspective view illustrating the contact state between the first protruding portion and the second protruding portion.
Figure 14:
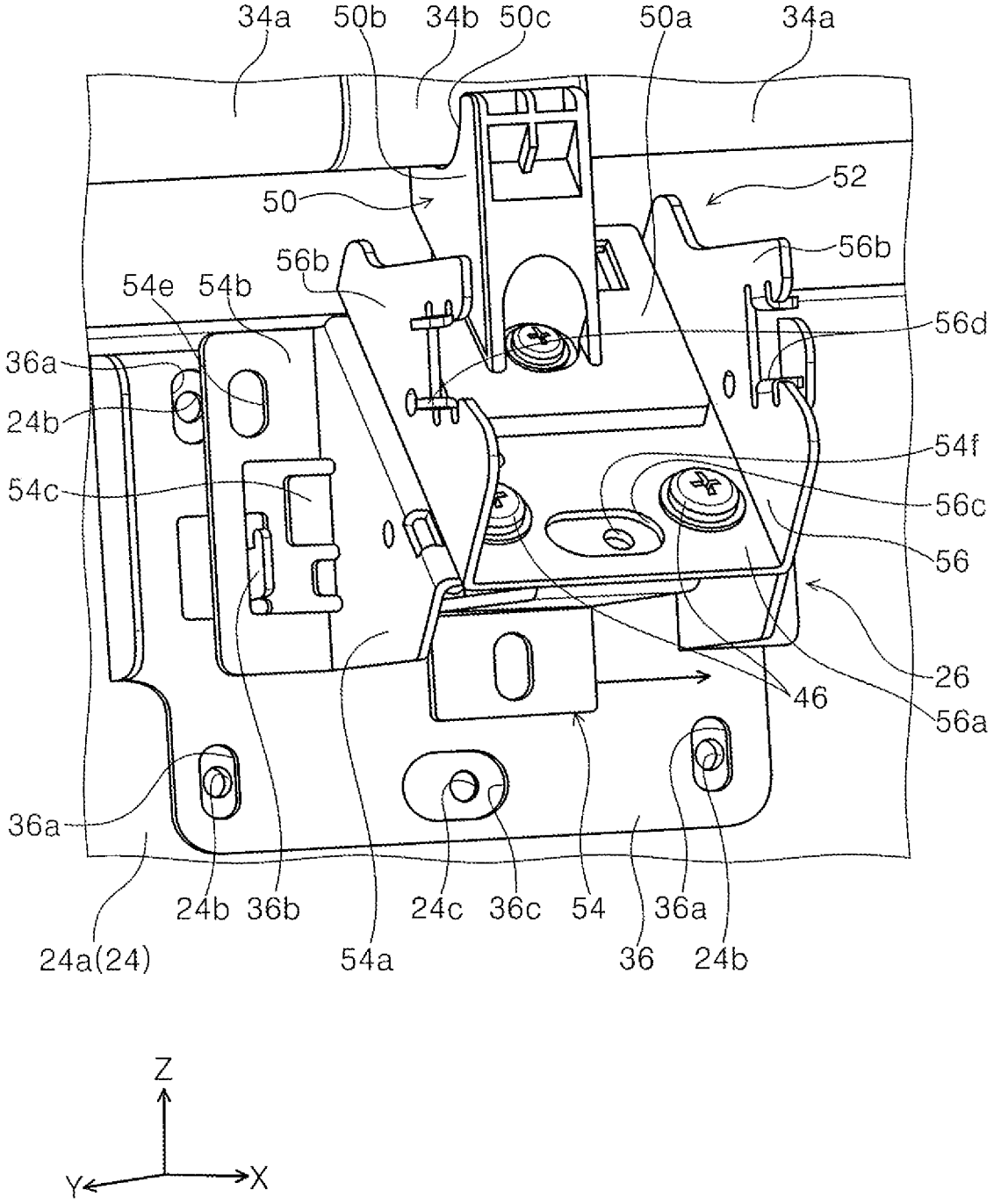
FIG. 14 is a perspective view illustrating a state where the driving roller support member is switched from a restriction state to an allowable state with respect to the base member.
Figure 15:
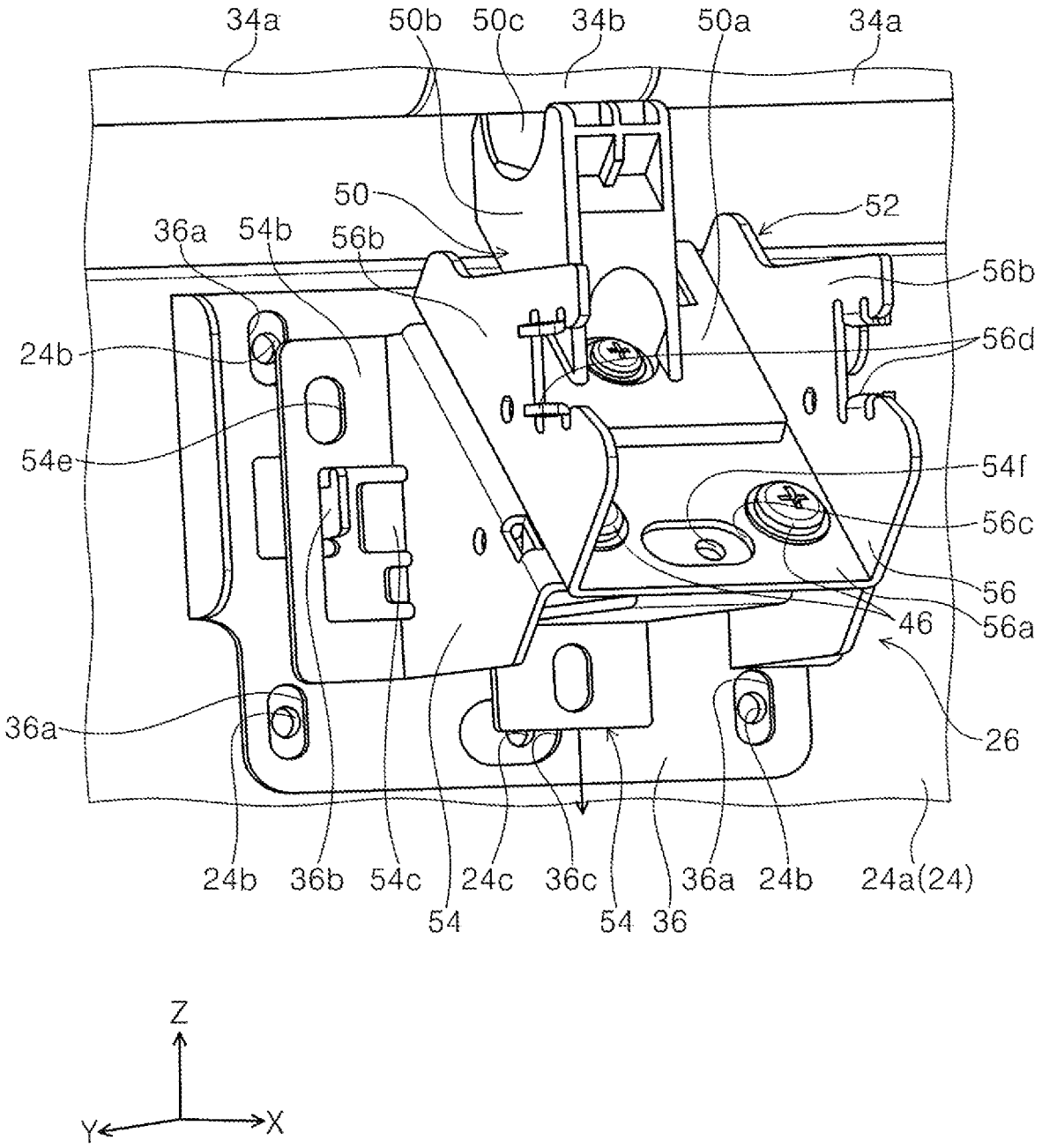
FIG. 15 is a perspective view illustrating a state where a contact state between a first support portion and the driving roller is released by changing a position of the driving roller support member downward in a device height direction with respect to the base member.
Figure 16:
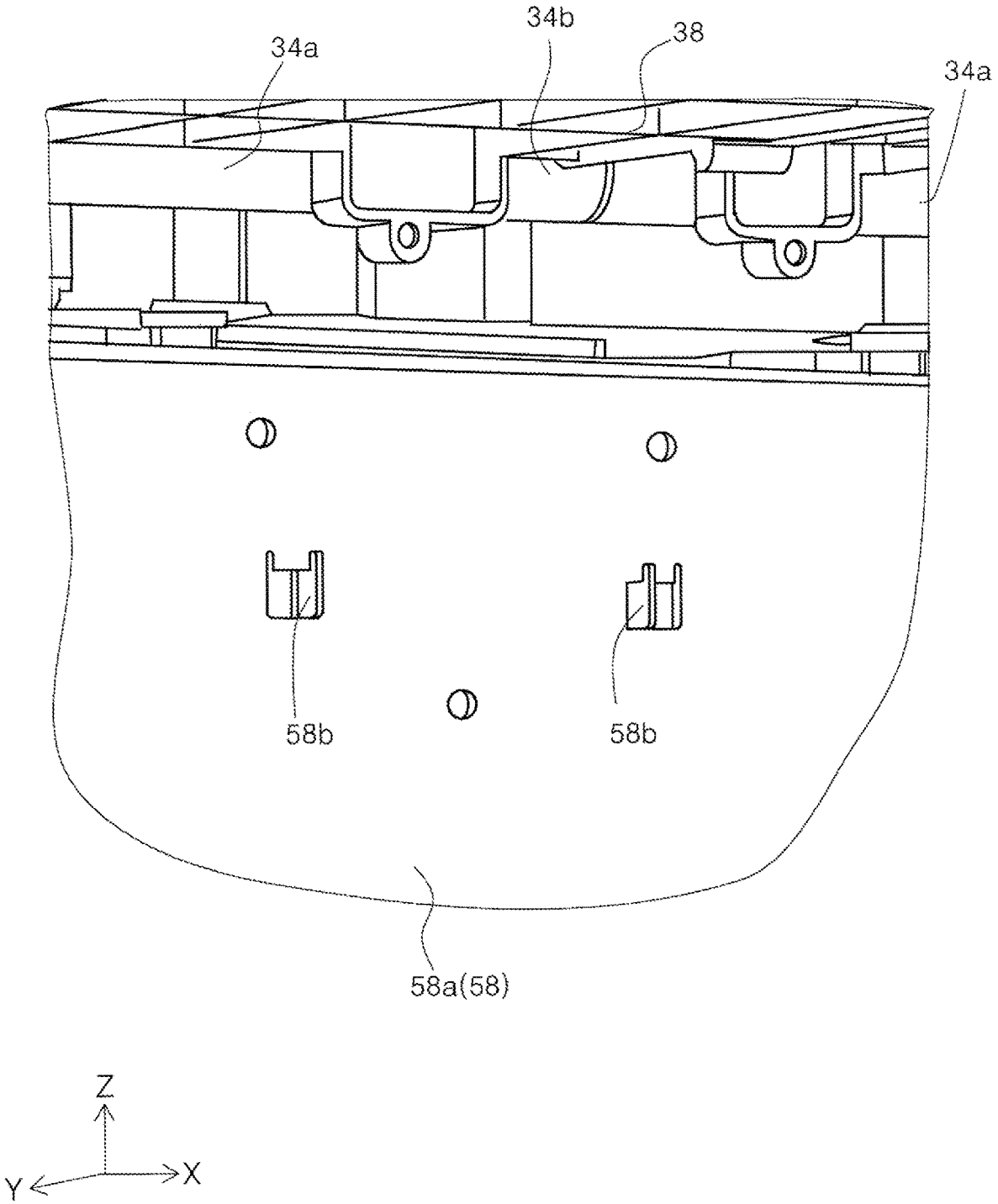
FIG. 16 is a perspective view illustrating a modified manner in which first protruding portions are provided on an attachment surface.

FIG. 13 is a perspective view illustrating the contact state between the first protruding portion and the second protruding portion. FIG. 14 is a perspective view illustrating a state where the driving roller support member is switched from a restriction state to an allowable state with respect to the base member. FIG. 15 is a perspective view illustrating a state where a contact state between a first support portion and the driving roller is released by changing a position of the driving roller support member downward in a device height direction with respect to the base member. FIG. 16 is a perspective view illustrating a modified manner in which first protruding portions are provided on an attachment surface.

In an X-Y-Z coordinate system illustrated in each of the drawings, an X-axial direction represents a device width direction and also a medium width direction, a Y-axial direction represents a medium transport direction in a recording device, and a Z-axial direction represents a device height direction. Note that, a +Y-axial direction side is a device front side and a −Y-axial direction side is a device rear side in each of the drawings.

Exemplary Embodiment

Overview of Recording Device

With reference to FIG. 1, an ink jet printer 10 (hereinafter a printer 10) as one example of a recording device is described. The printer 10 includes a device body 12 and a pair of leg portions 14. The pair of leg portions 14 are provided with some intervals in the X-axial direction on a lower portion of the device body 12.

A carriage 16 movable in the X-axial direction is provided in the device body 12. A recording head 18 is provided on a lower portion of the carriage 16. The recording head 18 discharges ink as "liquid" supplied from an ink tank (not illustrated) provided in the device body 12 onto a medium P, and performs recording. The medium P on which recording is performed in the exemplary embodiment is discharged from a discharge port 20 provided on the front side (+Y-axial direction side) of the device body 12.

In FIGS. 2 and 3, a cover member 22 is removably attached to the device body 12 on the rear side of the device body 12. As illustrated in FIG. 3, when the cover member 22 is removed from the device body 12, an attachment surface 24*a* of a frame 24 described later, a driving roller support member 26, and a path formation member 38 are exposed to the outside of the device body 12. This facilitates access to the driving roller support member 26 and the path formation member 38 provided in the device body 12, and the maintainability can be improved.

As illustrated in FIG. 4, a frame structure 30 is provided in the device body 12. In the exemplary embodiment, the frame structure 30 includes the frame 24, a pair of side frames 32, and a driving roller 34. The frame 24 extends in the X-axial direction. The side frames 32 are attached to a +X-axial direction side end portion of the frame 24 and a −X-axial direction side end portion of the frame 24. In other words, the side frames 32 include one side frame attached to one end portion of the frame 24 and the other side frame attached to the other end portion of the frame 24.

The driving roller 34 extends in the X-axial direction.

The driving roller 34 is configured as a metal shaft as one example and is provided with a roller portion 34*a* obtained by adhering a ceramic concentrically to an outer peripheral surface of the shaft at appropriate intervals in the X-axial direction. A region of the outer peripheral surface without adhering the ceramic, namely, a supported portion 34*b* in which the outer peripheral surface remains as it is as the metal shaft is provided on both sides of the roller portion 34*a* in the X-axial direction.

In the exemplary embodiment, both end portions in the X-axial direction of the driving roller 34 are supported by the side frames 32 as one example. In other words, the pair of side frames 32 rotatably support the both end portions in the X-axial direction of the driving roller 34. Furthermore, the driving roller 34 is supported by the driving roller support members 26, described later, at the supported portions 34*b* provided on a plurality of places close to a central portion in the X-axial direction. In the exemplary embodiment, the driving roller 34 is configured to be rotated and driven by receiving a drive force from a drive source (not illustrated), such as a drive motor provided in the device body 12.

With Regard to Configuration around Driving Roller

FIGS. 5 and 6 illustrate a relationship between the driving roller 34 and the driving roller support member 26. As illustrated in FIG. 6, the attachment surface 24*a* of the frame 24 is located on a −Z-axial direction side with respect to the driving roller 34. As illustrated in FIG. 5, the driving roller support member 26 is removably attached to the attachment surface 24*a* of the frame 24 through a base member 36 described later.

In the exemplary embodiment, the driving roller 34 is supported by the driving roller support member 26 from the −Z-axial direction side. The path formation member 38 is provided upstream (−Y-axial direction side) from the driving roller 34 in the transport direction (Y-axial direction) of the medium P. The path formation member 38 constitutes at least a part of a transport path 40 of the medium P. In FIG. 5, a position defining member 42 is attached to a lower portion of the path formation member 38. The position defining member 42 is supported by the driving roller support member 26.

A driven roller 44 rotated by the rotation of the driving roller 34 is provided above the driving roller 34. In the exemplary embodiment, the driven roller 44 is pressed against the driving roller 34 in the Z-axial direction by a pressing mechanism, which is not illustrated.

As illustrated in FIG. 7, the base member 36 is configured as a flat sheet metal member as one example. The base member 36 is provided with a plurality of through holes 36*a* configured to be inserted by fastening members 46 such as screws and bolts, a first protruding portion 36*b* protruding in the −Y-axial direction, and a position adjusting portion 36*c*. Note that, the through hole 36*a* is formed as an elongated hole extending in the Z-axial direction in the exemplary embodiment. While the base member 36 is attached to the attachment surface 24*a*, fastened portions 24*b* fastened to the fastening members 46 such as screws and bolts are provided in positions corresponding to positions of the through holes 36*a* in the attachment surface 24*a*. In the exemplary embodiment, the fastened portion 24*b* is configured as a screw hole. A recessed portion 24*c* is formed in a position corresponding to the position adjusting portion 36*c* in the attachment surface 24*a*.

In the exemplary embodiment, the base member 36 can be fixed to the attachment surface 24*a* by fastening the fastening members 46 to the fastened portions 24*b* with the fastening members 46 passing through the through holes 36*a*. In the exemplary embodiment, the through hole 36*a* allowing the fastening member 46 to pass through is configured as an elongated hole extending in the Z-axial direction. Therefore, with the fastening members 46 passing through the through holes 36*a* and temporarily fastened to the fastened portions 24*b*, the base member 36 can move within a range of dimensions in the Z-axial direction of the through holes 36*a* with respect to the attachment surface 24*a*. In other words, an attachment position of the base member 36 with respect to the attachment surface 24*a* can be adjusted with the fastening members 46 temporarily fastened to the fastened portions 24*b*.

FIG. 8 illustrates a specific adjustment method. In an upper diagram of FIG. 8, an eccentric tool 48 for position adjustment is attached to the position adjusting portion 36*c* and the recessed portion 24*c*. The eccentric tool 48 includes a first shaft portion 48*a* inserted in the recessed portion 24*c* and a second shaft portion 48*b* inserted in the position adjusting portion 36*c*. In the exemplary embodiment, the second shaft portion 48*b* has a diameter larger than a diameter of the first shaft portion 48*a*. The eccentric tool 48 has a configuration in which the first shaft portion 48*a* protrudes from a tip of the second shaft portion 48*b*. Further, a central axis of the first shaft portion 48*a* is deviated from a central axis of the second shaft portion 48*b*. In other words, the first shaft portion 48*a* is eccentric with respect to the second shaft portion 48*b*.

As illustrated in a lower diagram of FIG. 8, when the eccentric tool 48 attached to the position adjusting portion 36*c* and the recessed portion 24*c* is rotationally moved (see an arrow in FIG. 8), the eccentric tool 48 is rotationally moved with the first shaft portion 48*a* as a rotation center because the first shaft portion 48*a* is inserted in the recessed portion 24*c*. Since the second shaft portion 48*b* is eccentric with respect to the first shaft portion 48*a* herein, a rotation track of the second shaft portion 48*b* is deviated by an eccentric amount.

In this way, for example, a distance from the rotational movement center (the center of the first shaft portion 48*a*) to a contact position between the position adjusting portion 36*c* and the second shaft portion 48*b* changes by the rotational movement of the eccentric tool 48. As a result, the base member 36 is pushed up in the +Z-axial direction or pushed down in the −Z-axial direction by the rotational movement of the eccentric tool 48, and thus the attachment position of the base member 36 with respect to the attachment surface 24*a* can be adjusted. Note that, the lower diagram of FIG. 8 illustrates a state where a position of the base member 36 is changed toward the +Z-axial direction with respect to the attachment surface 24*a*.

In the exemplary embodiment, an operation of positioning the base member 36 with respect to the attachment surface 24*a* is basically performed in an operation of assembling the printer 10. Specifically, with the fastening members 46 temporarily fastened and the base member 36 temporarily fixed to the attachment surface 24*a*, the driving roller support member 26 is attached to the base member 36. In this state, the driving roller support member 26 is positioned with respect to the driving roller 34. Subsequently, the fastening members 46 are finally fastened, and the base member 36 is fixed to the attachment surface 24*a*. In this way, the base member 36 is positioned with respect to the attachment surface 24*a*.

Note that, the base member 36 is basically positioned with respect to the attachment surface 24*a* during the assembling of the printer 10. In this way, the positions of the base member 36 and the attachment surface 24*a* are defined, and position accuracy is secured. Therefore, the subsequent maintenance operation of the driving roller support member 26 is performed without removing the base member 36 from the attachment surface 24*a*. Thus, the operability of the maintenance operation of the driving roller support member 26 can be improved.

With Regard to Configuration of Driving Roller Support Member

FIGS. 9 and 10 illustrate a configuration of the driving roller support member 26. In FIG. 9, the driving roller support member 26 includes a first support member 50 and a second support member 52. In the exemplary embodiment, the first support member 50 includes a base portion 50*a* attached to the second support member 52 and a bearing portion 50*b* protruding from the base portion 50*a* toward the +Z-axial direction. A tip of the bearing portion 50*b* is formed as a recessed portion 50*c* recessed toward the −Z-axial direction. The recessed portion 50*c* is configured to be able to accept the supported portion 34*b* of the driving roller 34.

The second support member 52 includes a first inclined portion 54 and a second inclined portion 56. The first inclined portion 54 includes a first inclined portion body 54*a*, a base member attaching portion 54*b*, a second protruding portion 54*c*, and a first inclined surface 54*d*. The base member attaching portion 54*b* extending in the +X-axial direction and the −Y-axial direction is formed at a +Y-axial direction side end portion of the first inclined portion body 54*a*.

Furthermore, the second protruding portion 54*c* protruding toward the +X-axial direction and having a predetermined thickness in the Y-axial direction is formed at the +Y-axial direction side end portion of the first inclined portion body 54*a*. As illustrated in FIG. 6, the first inclined surface 54*d* extending in the −Y-axial direction and also in the −Z-axial direction and being inclined downward is formed on an upper portion of the first inclined portion body 54*a*. A through hole 54*e* allowing the fastening member 46 to be inserted is formed in the base member attaching portion 54*b*.

As illustrated in FIG. 6, the second inclined portion 56 includes a second inclined portion body 56*a*, side walls 56*b*, a position adjusting portion 56*c*, position defining member attaching portions 56*d*, and a second inclined surface 56*e*. As illustrated in FIG. 9, the base portion 50*a* of the first support member 50 is attached to the second inclined portion body 56*a*. The side walls 56*b* are formed at both X-axial direction end portions of the second inclined portion body 56*a*. The position defining member attaching portion 56*d* is formed on the side wall 56*b*. As illustrated in FIG. 6, the second inclined surface 56*e* extending in the −Y-axial direction and also in the −Z-axial direction and being inclined downward is formed on a lower portion of the second inclined portion body 56*a*.

As illustrated in FIG. 6, the first inclined surface 54*d* and the second inclined surface 56*e* have substantially the same inclined angle. The first inclined portion 54 and the second inclined portion 56 contact each other at the first inclined surface 54*d* and the second inclined surface 56*e*. In the exemplary embodiment, the second inclined portion 56 is configured to change a position with respect to the first inclined portion 54 by sliding the second inclined surface 56*e* along the first inclined surface 54*d*.

As illustrated in FIGS. 9 and 10, the second inclined portion 56 is fixed to the first inclined portion 54 by the fastening members 46. In the exemplary embodiment, the fastening members 46 are temporarily fastened to the first inclined portion 54, and thus a position of the second inclined portion 56 can be adjusted in a direction along the first inclined surface 54*d* with respect to the first inclined portion 54.

Specifically, a through hole 54*f* is formed in a position corresponding to the position adjusting portion 56*c* of the second inclined portion 56 in the first inclined surface 54*d*. Although it is not illustrated, the first shaft portion 48*a* of the eccentric tool 48 is inserted in the through hole 54*f*, and the second shaft portion 48*b* is inserted in the position adjusting portion 56*c*. When the eccentric tool 48 is rotationally moved in this state, a position of the second inclined portion 56 is changed along the first inclined surface 54*d*. In this way, a position of the second inclined portion 56 can be adjusted in a direction along the first inclined surface 54*d* with respect to the first inclined portion 54.

Next, positioning of the driving roller support member 26 with respect to the driving roller 34 is described with reference to FIGS. 6 and 11. The driving roller support member 26 is attached to the base member 36. Note that, at this time, the first inclined portion 54 is fixed to the base member 36 by the plurality of fastening members 46. In this state, the driving roller support member 26 is in a restriction state, described later, where movement of the driving roller support member 26 toward the −Z-axial direction with respect to the base member 36 is restricted.

In this state, the position adjusting portion 56*c* changes a position of the second inclined portion 56 with respect to the first inclined portion 54. In this way, a position of the first support member 50 is also changed in a direction along the first inclined surface 54*d* (FIG. 6) due to the change in the position of the second inclined portion 56 in the direction along the first inclined surface 54*d* (FIG. 6). As a result, a position of the bearing portion 50*b* of the first support member 50 is changed in the Y-axial direction and the Z-axial direction. Thus, a position in which the driving roller 34 is supported can be adjusted, and the first support member 50 and also the driving roller support member 26 can be positioned with respect to the driving roller 34.

After the first support member 50 is positioned with respect to the driving roller 34, the fastening members 46 passing through the second inclined portion 56 are fastened, and the second inclined portion 56 is fixed to the first inclined portion 54. Furthermore, the fastening members 46 passing through the base member 36 are fastened, and the base member 36 is fixed to the attachment surface 24*a* of the frame 24. In this way, the operation of positioning the driving roller support member 26 with respect to the driving roller 34 is completed.

With Regard to Maintenance of Driving Roller Support Member

FIGS. 11 to 15 illustrate a maintenance operation of the driving roller support member 26. FIG. 11 illustrates a state where the driving roller support member 26 is positioned with respect to the driving roller 34. In this state, the driving roller support member 26 is in the restriction state where movement of the driving roller support member 26 toward the −Z-axial direction with respect to the base member 36 is restricted. Specifically, as illustrated in FIGS. 12 and 13, the second protruding portion 54*c* of the first inclined portion 54 is located on the +Z-axial direction side with respect to the first protruding portion 36*b* of the base member 36, and the first protruding portion 36*b* and the second protruding portion 54*c* contact each other in such a way that the protruding directions intersect each other. In other words, the second protruding portion 54*c* also contacts the first protruding portion 36*b* from the +Z-axial direction side.

In this state, the first protruding portion 36*b* is in the state of supporting the driving roller support member 26. To remove the driving roller support member 26 from the base member 36, first, the fastening members 46 at three places are removed, which have been fasting the first inclined portion 54 to the base member 36. Note that, the bearing portion 50*b* of the first support member 50 is in the state of supporting the driving roller 34, so that the movement of the driving roller support member 26 toward the −Y-axial direction is restricted by the bearing portion 50*b*.

Subsequently, the position of the driving roller support member 26 is changed in a direction of an arrow illustrated in FIGS. 12 to 14, which is toward the +X-axial direction side as one example. In this way, the contact state between the first protruding portion 36*b* and the second protruding portion 54*c* is released. Thus, the driving roller support member 26 gets out of the state of being supported by the first protruding portion 36*b*, and the position of the driving roller support member 26 can change in the −Z-axial direction with respect to the base member 36. In other words, the driving roller support member 26 is brought into an allowable state where the position of the driving roller support member 26 is allowed to change toward the −Z-axial direction.

In FIG. 15, the driving roller support member 26 is switched from the restriction state to the allowable state, and thus the position of the driving roller support member 26 can change toward the −Z-axial direction with respect to the base member 36. The bearing portion 50*b* of the first support member 50 is separated from the driving roller 34 by changing the position of the driving roller support member 26 toward the −Z-axial direction. When the driving roller 34 comes out of the recessed portion 50*c* of the bearing portion 50*b*, the driving roller support member 26 can move toward the −Y-axial direction and the driving roller support member 26 can be removed from the base member 36.

In the exemplary embodiment, by switching the driving roller support member 26 from the restriction state to the allowable state, the positioning state can be released from the state where the driving roller support member 26 is positioned with respect to the driving roller 34 by moving the driving roller support member 26 in the −Z-axial direction. In this way, the driving roller support member 26 moves in a direction away from the driving roller 34. Thus, the driving roller support member 26 can be easily removed and replaced, and the maintainability of the driving roller support member 26 can be improved.

Conversely, when the driving roller support member 26 is attached to the base member 36, the driving roller support member 26 is attached to the base member 36 as illustrated in FIG. 15, and is slid to the −X-axial direction while being lifted in the +Z-axial direction. In this way, the first protruding portion 36*b* contacts the second protruding portion 54*c*, and the driving roller support member 26 is brought into the state of being supported by the base member 36. Next, the first inclined portion 54 is fixed to the base member 36 by the fastening members 46 as illustrated in FIG. 11.

Subsequently, the fastening members 46 are loosened, which have been fasting the first inclined portion 54 to the second inclined portion 56, and the second inclined portion 56 is then movable along the first inclined surface 54*d* with respect to the first inclined portion 54. The eccentric tool 48 is inserted in the position adjusting portion 56*c* and rotationally moved to position the bearing portion 50*b* of the first support member 50 with respect to the driving roller 34. At this time, the bearing portion 50*b* can be positioned with respect to the driving roller 34 in the Y-axial direction and the Z-axial direction, so that the positioning operation can be facilitated. After the bearing portion 50*b* is positioned with respect to the driving roller 34, the loosened fastening members 46 are fastened to fix the first inclined portion 54 to the second inclined portion 56.

With reference to FIGS. 5 and 6 again, the position defining member 42 is attached to the position defining member attaching portions 56*d* of the second inclined portion 56 of the driving roller support member 26. Therefore, the path formation member 38 is supported by the driving roller support member 26 through the position defining member 42. In the exemplary embodiment, the driving roller 34 and the path formation member 38 are supported by the driving roller support member 26, and thus the positions of the driving roller 34 and the path formation member 38 are defined by the driving roller support member 26. Furthermore, since alignment of the path formation member 38 can also be performed in the maintenance operation of the driving roller support member 26, the operability can be improved.

In the aspect, the driving roller support member 26 is configured to be removable from the attachment surface 24*a* through the base member 36. This can facilitate replacing the driving roller support member 26 and improve the maintainability of the driving roller support member 26 in the printer 10.

Modified Embodiment of Exemplary Embodiment (1) The exemplary embodiment has the configuration in which the both end portions in the X-axial direction of the driving roller 34 are supported by the side frames 32. Instead of this configuration, the driving roller support members 26 may be provided in positions corresponding to the both end portions in the X-axial direction of the driving roller 34 on the attachment surface 24*a* of the frame 24, and the both end portions of the driving roller 34 may be supported by the driving roller support members 26.

(2) The exemplary embodiment has the configuration in which the first protruding portion 36*b* is provided on the base member 36. Instead of this configuration, a first protruding portion 58*b* may be provided on an attachment surface 58*a* of a frame 58 as illustrated in FIG. 16. This eliminates the configuration of the base member 36, so that the number of parts can be reduced, and the removable structure of the driving roller support member 26 can be simplified.

(3) The exemplary embodiment has the configuration in which the driving roller support members 26 are provided at two places along an axial direction (the X-axial direction) of the driving roller 34. The configuration is not limited to this configuration, and the driving roller support member 26 may be provided at at least one or more places according to a length in the axial direction and a centrifugal whirling amount of the driving roller 34.

(4) The exemplary embodiment has the configuration in which the first protruding portion 36*b* protrudes in the −Y-axial direction. The configuration is not limited to this configuration, and the first protruding portion 36*b* may protrude in the X-axial direction. In this case, it is desired that an opening is formed in the attachment surface 24*a* or the attachment surface 58*a*, and the first protruding portion 36*b* protruding in the −X-axial direction does not interfere with the attachment surface 24*a* or the attachment surface 58*a*. Furthermore, in this case, it is preferable that the second protruding portion 54*c* protrudes toward the Y-axial direction and contacts the first protruding portion 36*b*. In other words, a direction in which the first protruding portion 36*b* protrudes may intersect a direction in which the second protruding portion 54*c* protrudes, and it is more preferable that a direction in which the first protruding portion 36*b* protrudes is orthogonal to a direction in which the second protruding portion 54*c* protrudes. Note that, the shape of the first protruding portion 36*b* and the shape of the second protruding portion 54*c* may be appropriately changed.

The driving roller support member 26 according to the invention is applied to the ink jet printer as one example of the recording device in the exemplary embodiment, but the driving roller support member 26 is also applicable to the other general liquid injection devices.

Herein, the liquid injection devices are not limited to recording devices such as printers, copying machines, and facsimiles that use an ink jet-type recording head, discharge ink from the recording head, and perform recording on a target recording medium. The liquid injection devices include devices that inject liquid for the equivalent use of ink instead of the ink from a liquid injection head corresponding to the ink jet-type recording head onto a target injection medium corresponding to the target recording medium, and allow the liquid to adhere to the target injection medium.

Examples of the liquid injection head include, in addition to the recording head, a color material injection head used for manufacturing a color filter of a liquid display and the like, an electrode material (conductive paste) injection head used for forming an electrode of an organic EL display, a surface emitting display (FED), and the like, a biological organic injection head used for manufacturing a biochip, and a sample injection head as a precision pipet.

Note that the invention is not intended to be limited to the aforementioned examples, and many variations are possible within the scope of the invention as described in the appended claims. It goes without saying that such variations also fall within the scope of the invention.

This application claims priority under 35 U.S.C. § 119 to Japanese Patent Application No. 2018-058170, filed Mar. 26, 2018. The entire disclosure of Japanese Patent Application No. 2018-058170 is hereby incorporated herein by reference.

What is claimed is:

1. A recording device comprising:

a driving roller configured to be driven by receiving a drive force from a drive source and transport a medium in a transport direction;

a frame located below the driving roller and including an attachment surface extending in a device height direction intersecting the transport direction;

a driving roller support member configured to support the driving roller; and a base member fixable to the attachment surface, wherein the driving roller support member is removably attached to the attachment surface, wherein the driving roller support member is removably attached to the attachment surface through the base member, wherein the base member is configured to be positioned with respect to the driving roller in a state in which the driving roller support member is attached to the base member, wherein the base member includes a first protruding portion protruding in the transport direction, wherein the driving roller support member includes a second protruding portion protruding in an axial direction of the driving roller intersecting the transport direction and the device height direction, wherein the second protruding portion comes into contact with the first protruding portion from upward in the device height direction, and wherein the driving roller support member is configured to be switchable between a restriction state and an allowable state, the restriction state being a state in which downward displacement of the driving roller support member in the device height direction is restricted when the second protruding portion comes into contact with the first protruding portion, and the allowable state being a state in which downward displacement of the driving roller support member in the device height direction is allowed when a contact state between the first protruding portion and the second protruding portion is released.

2. The recording device according to claim 1, wherein the driving roller support member includes a first support member configured to rotatably support the driving roller, and a second support member configured to support the first support member, the second support member includes a first inclined portion including a first inclined surface inclined with respect to the device height direction, and a second inclined portion configured to displace a position thereof along the first inclined surface and configured to support the first support member, and the second inclined portion is configured to:

position the first support member with respect to the driving roller in the transport direction and the device height direction by the second inclined portion displacing along the first inclined surface; and be fixable to the first inclined portion.

3. The recording device according to claim 1, comprising a pair of side frames including one side frame attached to one end portion of the frame and the other side frame attached to the other end portion of the frame in the axis direction, wherein the pair of side frames rotatably support both end portions of the driving roller in the axial direction.

4. The recording device according to claim 1, comprising:

a path formation member provided upstream from the driving roller in the transport direction and constituting a part of a transport path for the medium; and a position defining member configured to define a position of the path formation member in the device height direction, wherein the position defining member is supported by the driving roller support member.

5. The recording device according to claim 1, comprising:

a device body including the frame; and a cover member removably attached to a rear side of the device body, wherein the attachment surface and the driving roller support member are exposed to the outside the device body when the cover member is removed from the device body.

6. The recording device according to claim 1, comprising:

a recording head configured to discharge liquid to a medium fed by the driving roller, to perform recording.

7. A recording device comprising:

a driving roller configured to be driven by receiving a drive force from a drive source and transport a medium in a transport direction;

a frame located below the driving roller and including an attachment surface extending in a device height direction intersecting the transport direction; and a driving roller support member configured to support the driving roller, wherein the driving roller support member is removably attached to the attachment surface, wherein a first protruding portion protruding in the transport direction is formed on the attachment surface of the frame, the driving roller support member includes a second protruding portion protruding in an axial direction of the driving roller intersecting the transport direction and the device height direction, the second protruding portion comes into contact with the first protruding portion from the device height direction, and the driving roller support member is configured to be switchable between a restriction state and an allowable state, the restriction state being a state in which downward displacement of the driving roller support member in the device height direction is restricted when the second protruding portion comes into contact with the first protruding portion, and the allowable state being a state in which downward displacement of the driving roller support member in the device height direction is allowed when a contact state between the first protruding portion and the second protruding portion is released.

* * * * *